US008500414B2

(12) United States Patent
Aregger

(10) Patent No.: US 8,500,414 B2
(45) Date of Patent: Aug. 6, 2013

(54) METHOD OF CONTROLLING A GEAR PUMP AS WELL AS AN APPLICATION OF THE METHOD

(75) Inventor: Markus Aregger, Zurich (CH)

(73) Assignee: Maag Pump Systems AG, Oberglatt (CH)

( * ) Notice: Subject to any disclaimer, the term of this patent is extended or adjusted under 35 U.S.C. 154(b) by 352 days.

(21) Appl. No.: 12/818,502

(22) Filed: Jun. 18, 2010

(65) Prior Publication Data

US 2010/0322805 A1 Dec. 23, 2010

(30) Foreign Application Priority Data

Jun. 18, 2009 (EP) ..... 09163048

(51) Int. Cl.
*F04B 49/06* (2006.01)
*F04B 49/00* (2006.01)
*F01C 1/18* (2006.01)

(52) U.S. Cl.
USPC ..... 417/44.1; 417/530; 417/63; 417/410.4; 418/1; 418/206.1

(58) Field of Classification Search
USPC ..... 417/53, 63, 410.4, 44.2; 418/1, 2, 418/205, 206.1, 206.5
See application file for complete search history.

(56) References Cited

U.S. PATENT DOCUMENTS

| | | | | |
|---|---|---|---|---|
| 5,314,312 | A | 5/1994 | Ikemoto et al. | |
| 5,417,551 | A * | 5/1995 | Abe et al. | 417/203 |
| 5,709,537 | A * | 1/1998 | Maruyama et al. | 417/410.4 |
| 5,836,746 | A * | 11/1998 | Maruyama et al. | 417/44.1 |
| 5,971,714 | A * | 10/1999 | Schaffer et al. | 417/44.2 |
| 6,312,225 | B1 * | 11/2001 | Bussard | 417/16 |
| 6,485,274 | B2 * | 11/2002 | Kosters | 417/410.4 |
| 2005/0276714 | A1 * | 12/2005 | Klassen | 418/206.5 |

FOREIGN PATENT DOCUMENTS

| | | |
|---|---|---|
| CH | 659290 | 1/1987 |
| DE | 195 22 515 A1 | 1/1997 |
| EP | 0 382 029 A1 | 8/1990 |
| EP | 0 697 523 A2 | 2/1996 |
| EP | 0 886 068 B1 | 12/1998 |
| GB | 2123089 | 1/1984 |
| GB | 2123089 A * | 1/1984 |

OTHER PUBLICATIONS

European Search Report of Application No. EP 09 16 3048.3 dated Jan. 27, 2010.

* cited by examiner

*Primary Examiner* — Charles Freay
(74) *Attorney, Agent, or Firm* — Antonelli, Terry, Stout & Kraus, LLP.

(57) ABSTRACT

A method of controlling a gear pump comprising two meshing gear wheels (11, 12), wherein the two gear wheels (11, 12) are driven via respective shafts (2, 3) each by a drive unit (7, 8). A current position of the one gear wheel (11, 12) is determined with respect to the current position of the other gear wheel (12, 11), and the current position of the one gear wheel (11, 12) is continuously adjusted with respect to the current position of the other gear wheel (12, 11) according to specified predefined operating conditions.

12 Claims, 9 Drawing Sheets

METHOD OF CONTROLLING A GEAR PUMP AS WELL AS AN APPLICATION OF THE METHOD

TECHNICAL FIELD

The present invention relates to a method and an arrangement for controlling a gear pump comprising two meshing gear wheels, wherein the two gear wheels are driven via respective shafts each by a drive unit.

BACKGROUND AND SUMMARY

Gear pumps consist of two meshing gear wheels which are mounted on shafts, wherein generally one shaft is connected to a drive unit. The shaft which is not being driven by a drive unit is driven by torque transmission from the shaft being driven via the tooth flanks.

Often problems of wear occur at the tooth flanks through excessive contact pressure due to the torque transmission. Namely, on the one hand because the pressure load brought about by the pressure difference needs to be transferred via the tooth flanks from the shaft being driven to the driven shaft, and on the other hand because the friction needs to be overcome. Damages on the tooth flanks can occur through abrasion or wear (pittings, micro-weldings, abrasion), especially in the manufacturing of polymers in large polymerization installations or in compounding of plastics with large throughputs at very high backpressures and high temperatures, i.e. overall high torque.

In order to avoid these damages two shaft drives have already been used, for which the propulsion takes place with a single drive unit (motor), and then subsequently the force is distributed by a mechanical transfer box to the two gear pump shafts.

Furthermore, from the patent CH-659 290 a gear pump is known in which the two shafts are each driven with a drive unit. Each of the two gear wheels draws the necessary drive power from the associated drive unit. Only relatively minor power differences are transmitted between the two gear wheels.

From the EP-0 886 068 B1 a gear pump is known in which again two drive units are provided for individually driving the shafts, where the phase and angular velocity of the meshing gear wheels are coordinated in such a way that on the one hand a lifting off of tooth flanks of the meshing gear wheels and on the other hand an excessive excess torque on the tooth flanks of the meshing gear wheels are avoided.

It has been shown that in known gear pumps the wear, especially when conveying abrasive media, can be substantial.

In particular in extrusion applications of highly filled, abrasive polymer melts the problem of high tooth flank wear due to abrasion can occur and thus the problem of premature failure of the gear wheel shafts arises, since abrasive particles contained in the melt are ground between the tooth flanks. Thereby, damage and abrasion of the surface of the tooth flanks can be caused. Furthermore, the viscosity of the melt is increased due to loading with filler material and therewith the torque requirement of the entire pump or the required torque at the individual shafts rises, so that a possible exceedance of the allowed contact pressure at the tooth flanks again becomes the focus of attention.

It is therefore an object of the present invention to provide a method of controlling a gear pump with which an improvement is achieved with respect to a least one of the mentioned disadvantages.

This object is achieved by the method of the invention of controlling a gear pump which comprises determining a current position of the one gear wheel with respect to the current position of the other gear wheel, and continuously adjusting the current position of the one gear wheel with respect to the current position of the other gear wheel according to specified predefined operating conditions. Preferred embodiments as well as an application/arrangement according to the invention are disclosed hereinafter.

The present invention relates to a method of controlling a gear pump comprising two meshing gear wheels, wherein the two gear wheels are driven via respective shafts each by a drive unit. The invention is characterized in that a current position of the one gear wheel is determined with respect to the current position of the other gear wheel and that the current position of the one gear wheel is continuously adjusted with respect to the current position of the other gear wheel according to specified predefined operating conditions.

One embodiment is characterized in that the determination of the present position of the one gear wheel with respect to the present position of the other gear wheel is adjusted via a reference value, which is determined before the normal operation of the gear pump or during interruptions of the normal operation of the gear pump.

Further embodiments of the present invention are characterized in that the reference value lies in the middle between tooth flanks of a tooth space of a gear wheel, preferably in the middle between tooth flanks of a tooth space of a gear wheel.

Further embodiments of the present invention are characterized in that the reference value is determined in that,

- the one gear wheel is driven by the other gear wheel with a predetermined torque,
- a first angle difference is determined by calculating the difference between values measured with the rotary encoders/sensor units,
- the other gear wheel is driven by the one gear wheel with a predetermined torque,
- a second angle difference is determined by calculating the difference between values measured with the rotary encoders/sensor units,
- a difference is determined between the first angle difference and the second angle difference, and
- the reference value is specified within the determined difference.

Thus a method for automatically calibrating the arrangement including a gear pump is provided. The system can perform this calibration both before the beginning of operation as well as during service interruptions without further action by the operator. With this method a possible wear of tooth flanks can also be detected, since then the difference between the first angle difference and the second angle difference also changes or increases. An excessive wear can then be simply detected when exceeding a threshold value.

Further embodiments of the present invention are characterized in that at least one of the following current values is monitored:

- the first angle difference,
- a difference between the first angle difference and the reference value,
- the second angle difference,
- a difference between the second angle difference and the reference value, and that in case of under- or overshooting of the at least one of the current values below a predefined value at least one of the following actions is executed:

- an optical warning,
- optical display, acoustic warning, change of operating conditions of the gear pump.

Further embodiments of the present invention are characterized in that rotary encoders/sensor units are applied for determining the current position of the one gear wheel and the second gear wheel, wherein each rotary encoder/sensor unit is arranged centrally between the toothing of the respective gear wheel and a rotor of the respective drive unit.

A central arrangement of the rotary encoders/sensor units has the advantage that an existing torsion angle due to a non-ideal stiffness of the entire drive train has a reduced influence on the measurement error of the system. The measurement error is halved by the central arrangement.

Further embodiments of the present invention are characterized in that a predefined gear lash is adjusted between two meshing gear wheels.

Further embodiments of the present invention are characterized in that a leading flank, in the direction of rotation of the one gear wheel, of a tooth meshing into a tooth gap touches a lagging flank, in the direction of rotation of the other gear wheel, and that a leading flank, in the direction of rotation of the other gear wheel, of a tooth meshing into a tooth gap touches a lagging flank, in the direction of rotation of the one gear wheel.

This operation condition is also referred to a changeover of flanks since the flanks touching each another will change during the course of the extrusion process.

Further embodiments of the present invention are characterized in that the one gear wheel drives the other gear wheel with a predetermined torque, wherein the predetermined torque is greater than half of the total torque generated by both drives.

A precise torque setting can be achieved by appropriate control of the rotary speed or current positions of the gear wheels to each other. The tooth flanks thus transfer an arbitrary adjustable torque, however they never lift off from each other during operation if a defined flank sealing is always to be achieved.

Further embodiments of the present invention are characterized in that the rotary speed of the shafts driven by the drive units is synchronously adjusted in such a way that a pressure of the medium to be conveyed stays substantially constant on a discharge side of the gear pump.

The advantage associated with this is that no disturbing pulsation is present at the discharge side of the gear pump anymore, which is reflected in the quality of the extrudate.

Further embodiments of the present invention are characterized in that the pressure of the medium to be conveyed is measured on the discharge side of the gear pump and that the rotary speed is adjusted in dependence of the measured pressure of the medium.

Furthermore, an application of the method according to the present invention is provided for an arrangement including a gear pump, comprising a pump housing, two meshing gear wheels contained in the pump housing and two shafts which are operatively connected to the gear wheels and extend through the pump housing, wherein the two shafts are each operatively connected to respective drive units. According to the invention it is provided that a coupling unit for compensation of eccentricities between the drive unit and the respective shaft is arranged between each gear wheel and drive unit and that a rotary encoder/sensor unit is arranged between the center of the gear wheel and the center of the respective drive.

One embodiment of the present application is characterized in that the rotary encoder/sensor unit is located in an axial region which is defined by the center between the center of the gear wheel and the center of the drive plus a deviation on both sides of at most 10% of the distance between the center of the gear wheel and the center of the drive.

Further embodiments of the present application are characterized in that rotary encoders/sensor units are respectively arranged in the middle between the respective center of the gear wheel and the respective center of the drive.

Further embodiments of the present application are characterized in that the rotary encoders/sensor units feature a radial distance to the rotation axis of the respective shaft which is larger, preferably at least twice as large, as the outer radius of the gear wheels.

Further embodiments of the present application are characterized in that the rotary encoders/sensor units are either optical or magnetic rotary encoders/sensor units.

Further embodiments of the present application are characterized in that the rotary encoders/sensor units are arranged such that a connecting line which runs through the corresponding rotary encoder/sensor unit and extends perpendicularly from the shaft encloses together with a plane which extends centrally between the two rotation axes on a suction side an angle in the range of 35° to 55°, preferably 40° to 50°, preferably 45°.

Further embodiments of the present application are characterized in that each drive unit features a rotor and a stator, wherein the rotor is axially moveable with respect to the stator.

Further embodiments of the present application are characterized in that the drive unit features on the far side with respect to the gear pump a differential bearing unit which radially supports the rotor of the drive unit.

Further embodiments of the present application are characterized in that the rotor of the drive unit is connected to the respective shaft of the gear pump via a coupling unit.

Further embodiments of the present application are characterized in that the coupling unit is a membrane coupling.

Further embodiments of the present application are characterized in that a flange is arranged between the pump housing and the stator of the respective drive unit, wherein the flange features bores through which a cooling agent circulates for adjusting the temperature.

Further embodiments of the present application are characterized in that the drive units are connectable to the respective shaft of the gear pump from the far side with respect to the gear pump.

Further embodiments of the present application are characterized in that the connections between the drive units and the respective shafts of the gear pump are conical polygon connections.

Further embodiments of the present application are characterized in that the drive units are of the torque motor type.

Further embodiments of the arrangement according to the invention are characterized in that the one drive unit, the gear pump and the other drive unit are each contained in a temperature zone in which the temperatures are adjustable to specified values, wherein preferably isolation regions are present between neighboring temperature zones.

BRIEF DESCRIPTION OF DRAWINGS

The invention will be explained in the following with the help of drawings in which embodiments of the present invention are illustrated. Thereby showing.

DETAILED DESCRIPTION

Figure 1:
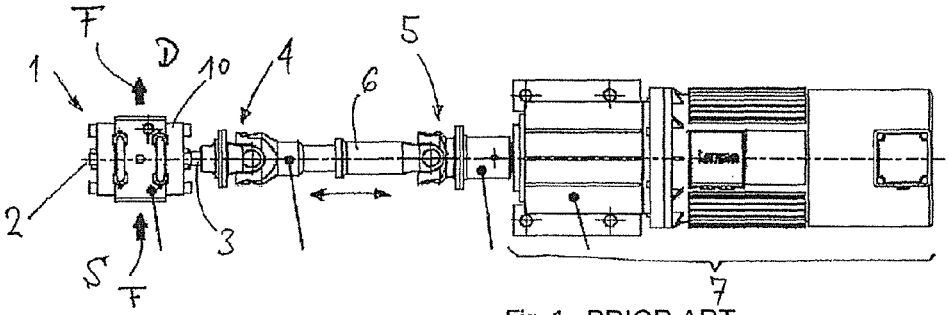
Fig. 1 PRIOR ART
FIG. 1 a known arrangement with one gear pump and one drive unit.

In FIG. 1 a known arrangement including a gear pump 1 is shown which conveys a medium F to be conveyed from a suction side S to a discharge side D. A pump housing 10 can be seen in FIG. 1 through which two shafts 2 and 3 extend to the outside. The shaft 3 extending to the outside is connected to a drive unit 7 via a first universal joint 4, an axle segment 6 whose length is adjustable and a second universal joint 5. Accordingly, also the shaft 2 extending to the outside is connected to a further drive unit (not shown in FIG. 1) via a corresponding first and second universal joint as well as via a corresponding axle segment. Thus, the gear wheels (not visible in FIG. 1) are each propelled by an own drive unit.

It should be noted that the double universal joint consisting of the first and the second universal joint 4 and 5 together with the adjustable axle segment 6 is provided to accommodate lateral and angular deviations of the drive unit in relation to the shafts 2 or 3. Through the double universal joint in combination with the adjustable axle segment 6 an additional bearing force acts on a shaft bearing contained in the pump housing 10. This additional bearing force arises due to the self-weight of the double universal joint and the axle segment 6. The additional bearing force is considerable because of a relatively short distance between the pump bearings, which are located in the pump housing 10 to support the shafts 2 and 3, with respect to the length of the double universal joint.

Figure 2:
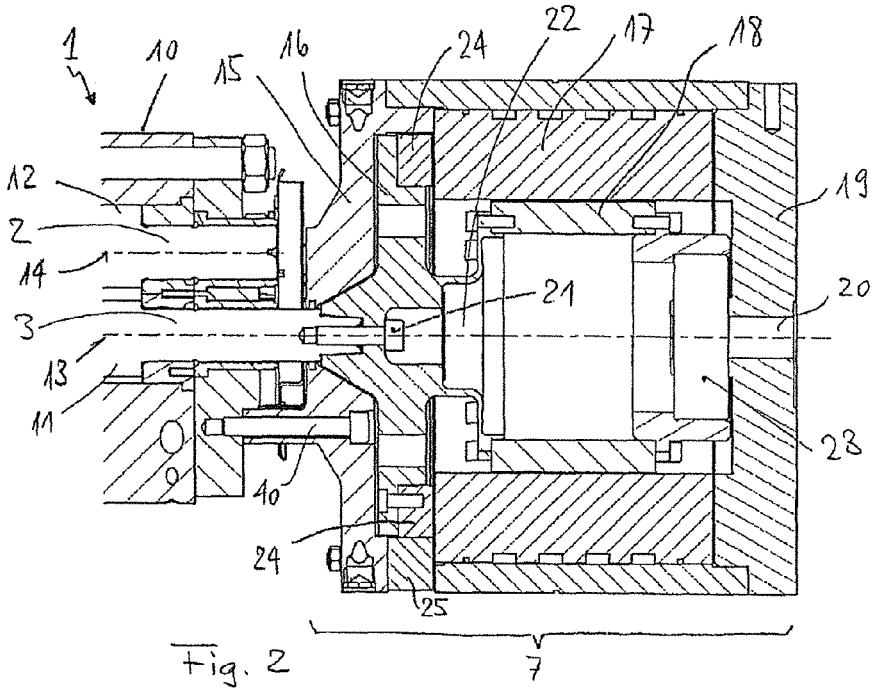
FIG. 2 a sectional view through the cutting plane A-A indicated in FIG. 4 of an arrangement according to the invention including a gear pump and a drive unit, FIG. 3 a schematic representation of the arrangement according to the invention with information on temperature zones, FIG. 4 a position for rotary encoder and sensor unit to determine the current position of the gear wheels, FIG. 5 a transversal cut through the rotation axes of the shafts in area of the gear wheels to illustrate a first operating condition, FIG. 6 again a transversal cut through the rotation axes of the shafts in area of the gear wheels to illustrate a second operating condition, FIG. 7 again a transversal cut through the rotation axes of the shafts in area of the gear wheels to illustrate a third operating condition, FIG. 8 again a transversal cut through the rotation axes of the shafts in area of the gear wheels to illustrate a fourth operating condition, and FIG. 9 a graph with a rotary speed curve, a pressure curve and a torque curve as a function of time.
Figure 4:
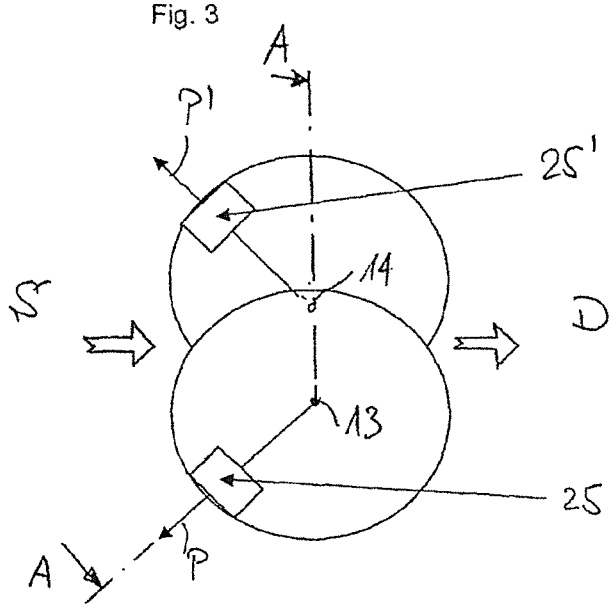

FIG. 2 shows a sectional view through an arrangement according to the invention including a gear pump 1, wherein the cutting plane is placed in the rotary axes 13 and 14 of the shafts 2 and 3 and through a sensor 25, according to the cutting plane A-A marked in FIG. 4. For the sake of simplicity FIG. 2 only shows half of the gear pump 1. Accordingly, also only one drive unit 7 is shown. The drive unit 7 is pressed via a flange 15 directly, i.e. without an intermediate gearing, to the pump housing 10 or rather its cover. The rotating parts of the drive unit 7, such as a hub 16, membrane coupling 22 and a rotor 18, are connected to the shaft 3 of the gear pump 1 via a screw 21. The screw 21 can be loosened if required, whereby the drive unit 7 in turn can be unfastened from the gear pump 1. After the loosening of the screw 40, which joins the flange 15 with the pump housing 10 or rather its cover, and after loosening the screw 21 the entire drive unit 7 can be unfastened from the gear pump 1. The shafts 2, 3 of the gear pump 1 and their bearing unit remain within the gear pump 1 and can be disassembled individually.

Apart from the flange 15 and the hub 16, the drive unit 7 further comprises a rotor 18, a stator 17 and a drive cover 19 with an opening 20. The drive cover 19 closes the drive unit 7 on the far side of the gear pump 1 and is connected to the stator 17, wherein the opening 20 is centrally arranged on the extended rotary axis 13 of the shaft 3. On the near side of the gear pump 1, the stator 17 is connected to the flange 15.

As already stated, the gear pump 1 is connected directly, i.e. without an intermediate gearing, to the drive unit 7. For this the screw 21 is provided, with the help of which the rotor 18 is axially fixed via the hub 16 and the flange 15. During the assembly of the drive unit 7 to the gear pump 1 the screw 21 is passed through the opening 20 in the drive unit 7 and along the rotary axis 13 of the shaft 3 and is fastened in a corresponding bore in the shaft 3. Thereby, the hub 16 is connected to the shaft 3 via a so-called conical polygon connection, which on the one hand makes possible an exact alignment of the rotor 18 with the shaft 3, and on the other hand makes possible an extremely torsion proof connection between the rotor 18, the drive unit 7 and the shaft 3, which is to be driven, of the gear pump 1.

It is already clear from the comparison of the known arrangement according to FIG. 1 and the arrangement according to the invention according to FIG. 2 that the arrangement according to the invention is comparatively extremely short and also yields a torsion proof connection due to the short rotary axis connection between the rotor 18 and the gear wheel 11. This is of importance especially in connection with the method according to the invention that is still to be explained.

Since, as with the double universal joint according to FIG. 1, the arrangement according to FIG. 2 also requires an angular and a lateral compensation, on the one hand a membrane coupling 22 at the side of the gear pump end of the rotor 18—for the angular compensation—and on the other hand the stator 17 and the rotor 18 are formed such that the rotor 18 can be axially moved with respect to the stator 17, in order to make possible a lateral compensation.

It is for instance also conceivable that the membrane coupling 22 and the hub 16 are a single part, as apparent from FIG. 2, wherein in the left half on the driving side the single part fulfills the classical function of a hub, which can be coupled to the shaft 3, and wherein in the right half this single part is thin-walled and fulfills the function of the membrane coupling.

Apart from the stated support of the rotor 18 with respect to the stator 17 on the side of the gear pump 1 by means of flange 15 and hub 16—via conical polygon connection and screw 21—, a differential bearing unit 23 is provided on the far side with respect to the gear pump 1, that radially holds the rotor in position with respect to the stator 17.

Eccentricities of the rotary axis 13 of the shaft 3 with respect to a rotary axis of the differential bearing 23 due to manufacturing tolerances can be compensated for via a membrane coupling 22. Indeed an additional loading of the gear pump bearings arises because of the eccentricities due to manufacturing tolerances, however the resulting reactions of the moment remain within relatively narrow boundaries, since the distance of the membrane coupling 22 to the loaded bearing is short and since only a moderate angular compensation has to be accomplished.

For instance, a so-called torque motor is employed as drive unit 7, which is a multi-pole, permanently excited three-phase synchronous motor with hollow rotor shaft, for the direct coupling to the gear pump 1 stated above. Torque motors are characterized in particular by a short compact design and a low skew slackness (high torsional stiffness).

As will become apparent from the following explanations regarding the operation of the arrangement including a gear pump 1, accurate information on the current position of the one gear wheel with respect to the other gear wheel is important. At the same time, there is a demand for a direct and unbiased influence of the drive units on the gear wheels of the gear pump. One criterion is the already stated low skew slackness (high stiffness) between the drive unit and the driven gear wheel. A further criterion is an as accurate as possible measurement of the current position of the one gear wheel with respect to the current position of the other gear wheel.

In the embodiment according to FIG. 2 this is achieved in that a rotary encoder 24 is arranged at the periphery of the hub 16 which interacts with a sensor unit 25 that is connected to the stator 17. For instance, a grid pattern is applied on the hub 16 that can be read by the sensor unit 25. Instead of such an optical measurement device a corresponding magnetic measurement device or another method for determining the position can be employed.

In order to minimize a possible measurement error due to an eccentricity between the rotary encoder 24 and the gear teeth, the diameter of the rotary encoder 24 is implemented as large as possible. The eccentricity of the rotary encoder 24 itself is minimized by integration of the receptacle for the rotary encoder 24 into the hub 16. Since the hub 16 is made in one-piece very tight manufacturing tolerances can be maintained for the receptacle for the rotary encoder 24.

The position of the rotary encoder 24 and of the sensor unit 25 is preferably chosen between the middle of the rotor 18 and the stator 17 and the middle of the driven gear wheel 11 of the gear pump 1. For a uniform stiffness distribution over the drive train (i.e. between the center of the rotor 18 and stator 17 and the center of the driven gear wheel 11 of the gear pump 1) the rotary encoder 24 is preferably arranged in the middle between the center of the rotor 18 and stator 17 and the center of the driven gear wheel 11 of the gear pump 1.

Figure 3:
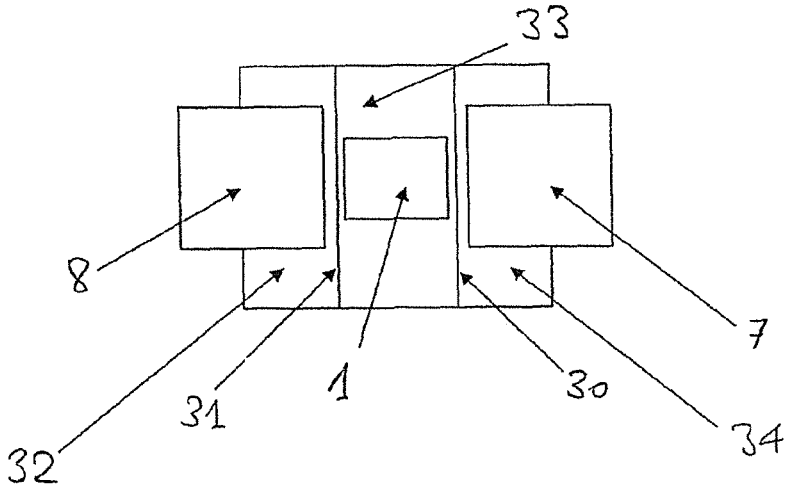

One possible area of application of the arrangement including a gear pump is the pressure build-up downstream from the extruder in conveying of plastic melts in an extrusion line. In these applications polymer melts are conveyed at a temperature of 300° C. against high discharge pressures (e.g. 300 bar). For this high drive powers and therewith also high torques are necessary. Accordingly, the gear pump and the pump housing is heated to a temperature of for instance 300° C. due to the medium to be conveyed, whilst the temperature of the drive units 7 and 8 should not exceed 60° C. particularly because of the electronic circuits used with these. To illustrate these circumstances FIG. 3 shows the arrangement including a gear pump 1 according to the invention, where now the gear pump 1 and the two laterally arranged drive units 7 and 8 are represented as simple blocks. The individual components are contained in temperature zones 32, 33 and 34, which have to exhibit permitted or required temperature values according to the foregoing statements. Thus, the gear pump 1 is included in the temperature zone 33, which is operated at the temperature of the medium to be conveyed, for instance at 300° C. On the drive side, the drive units 7 and 8 are provided in the temperature zones 32 and 34, respectively, the maximum value of which is not allowed to exceed 60° C. for a proper functioning. The present arrangement requires the positioning of electrical components in the immediate vicinity of the gear pump 1. Since the gear pump is heated up to 300° C. insulating separating walls 30 and 31 are required which are present between the temperature zones 32 and 33 and between the temperature zones 33 and 34, respectively. Apart from the insulating separating walls 30 and 31 further measures are required as necessary so that the temperature in the cold temperature zones 32 and 34 does not reach inadmissible values. An additional measure for instance consists in providing an active cooling system (e.g. an active water cooling system).

It is also conceivable to protect the rotor 18 (FIG. 2) from overheating by inserting a cooling of the flange 15 between the hub 16 and the gear pump 1. Thereby, the cooling is for instance implemented as star shaped bores in the flange 15. Herewith, very good cooling properties are achieved since the deflections generate high turbulences. The hub is cooled on the entire flange side surface by irradiation and forced convection.

FIG. 4 shows a possible positioning of the sensor unit 25, which is employed to determine the current position of the one gear wheel with respect to the other gear wheel, where FIG. 4 shows a cut across the rotary axes 11 and 13 of the shafts 2 and 3. The medium to be conveyed is advanced in the direction of the arrow from the suction side S to the discharge side D. In doing so a force component is generated in the direction of the arrows P, P', which act on the shaft bearing of the gear pump and lead to a minor displacement of the shafts 2 and 3 (FIG. 2).

In order to compensate for the eccentricity caused by the displacement the sensor unit 25 will now be arranged in the direction of the displacement, i.e. in the direction of the deflection of the shaft. The mounting takes place for instance at 45° and is therefore in the average of the possible displacement angles, which is dependent on the pressure difference and the viscosity. In case of insufficient accuracy caused by the displacement of the shaft and the deflection, an arrangement of the sensor unit 25 can for instance be employed which is dependent on the width of the gear wheels and the value of the backlash.

Based on the FIGS. 5 to 9 different operating conditions are explained in the following which can be specified as predefined procedures for the operation of the arrangement including a gear pump.

Figure 5:
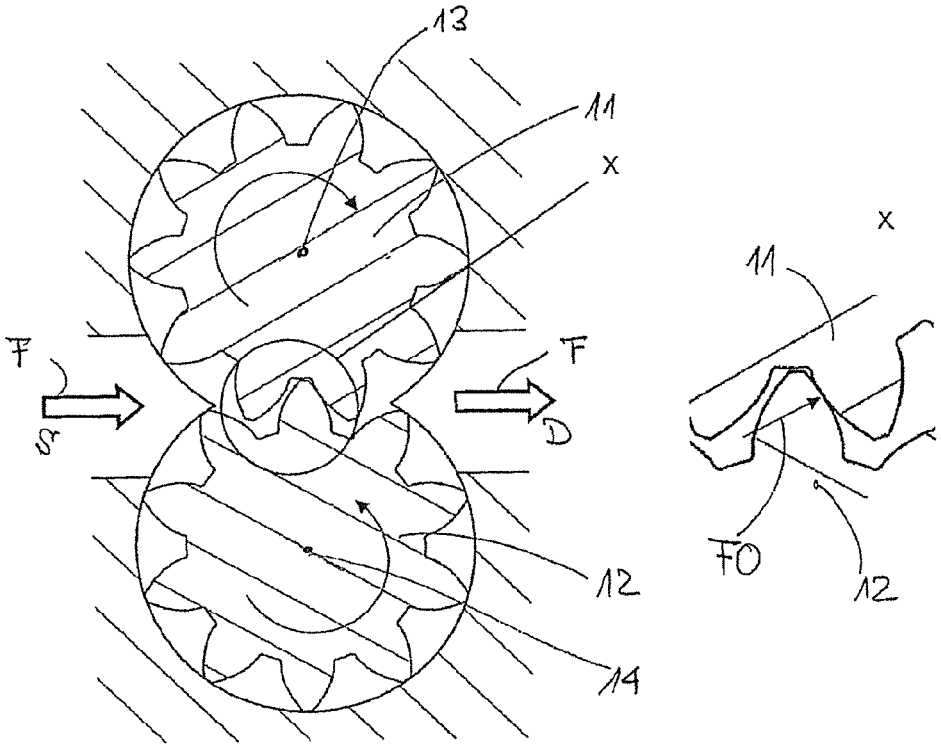

FIG. 5 shows a cut across the rotary axes 11 and 13 in the region of the gear wheels 11 and 12. The medium F to be conveyed is picked up by the tooth gaps on the suction side S and subsequently transported along the pump housing to the discharge side D where the medium F is extruded by the cogging gear wheels 11, 12.

During operation of the gear pump a "trapped volume" is formed in the region of the toothing between the bottom and the face of the tooth that is sealed off by the tooth flanks, which are almost touching each other, in front of and behind this volume. However, for fluidic purposes a flow gap can specifically be generated at those locations at which a large flow gap is desired for tribological reasons (optimal gap width in relation to the relative speed of the tooth flanks). The ratio of these two sealing gaps can be actively controlled by the existing position control of the shafts. Once the gap moving in advance of the "trapped volume" can be minimized and once the gap following the "trapped volume" can be minimized. Thus, it is possible to actively influence the extruding process from this "trapped volume", with which the uniformity of the flow can be optimized.

Figure 10:
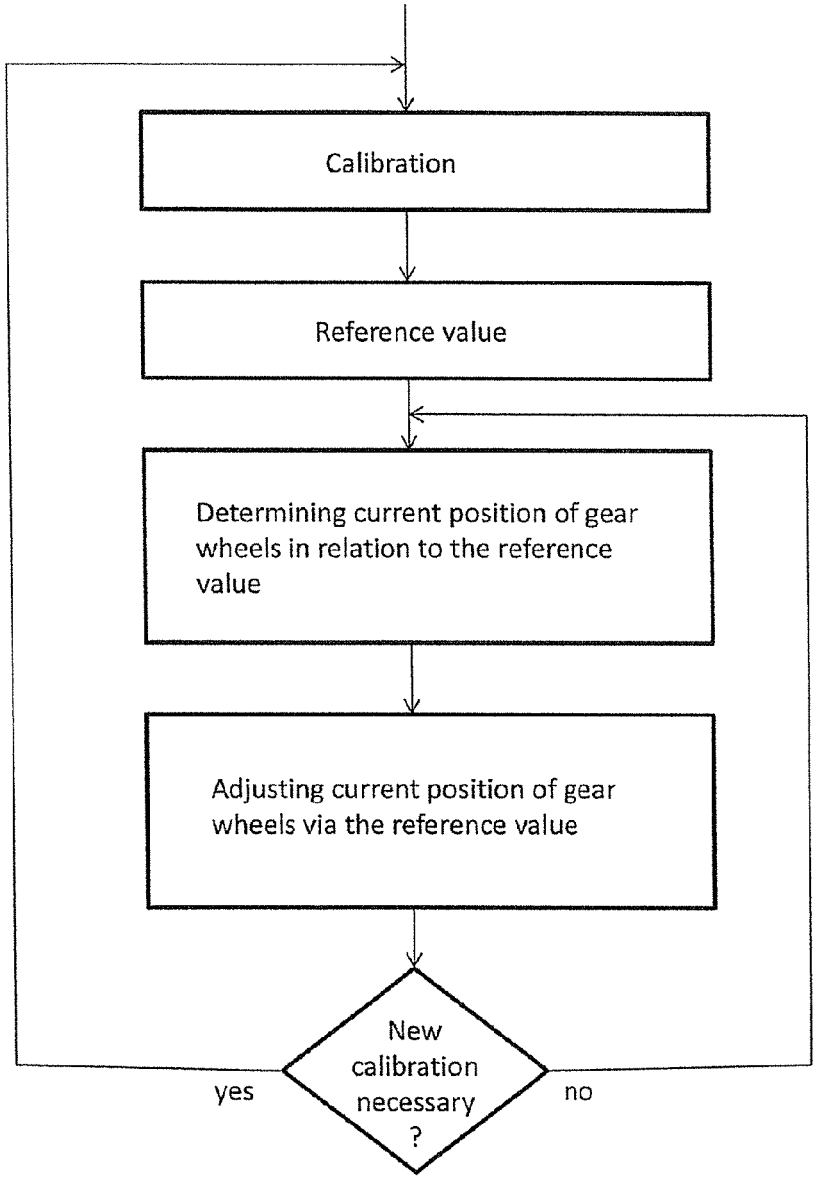
FIG. 10 a flow chart containing the general concept of the method according to the invention, FIG. 11 a flow chart of steps of the method in connection with the "calibration" step of the method as identified in FIG. 10.

In order to adjust the various operating states and conditions of the arrangement according to the invention information regarding the current position of the one gear wheel 11 with respect to the current position of the other gear wheel 12 must be known. This information constitutes the actual initial conditions which are necessary for further adjustment of the gear wheels to each other. One possibility to determine this information consists of the execution of the following process steps which constitutes a calibration:

The calibration is generally identified as a single step in the flow chart of the method as shown in FIG. 10. This calibration involves the steps/operations shown in FIG. 11. That is, in a first step the first shaft 2 drives the second shaft 3 with a predefined torque. Thereby, a first absolute rotation angle difference as indicated in FIG. 11 is determined with the help of the stated rotary encoder 24 in combination with the sensor unit 25 (FIG. 2) at each shaft 2 and 3 in that a difference is determined between the measured value of the one sensor unit 25 and the measured value of the other sensor unit 25'.

Figure 11:
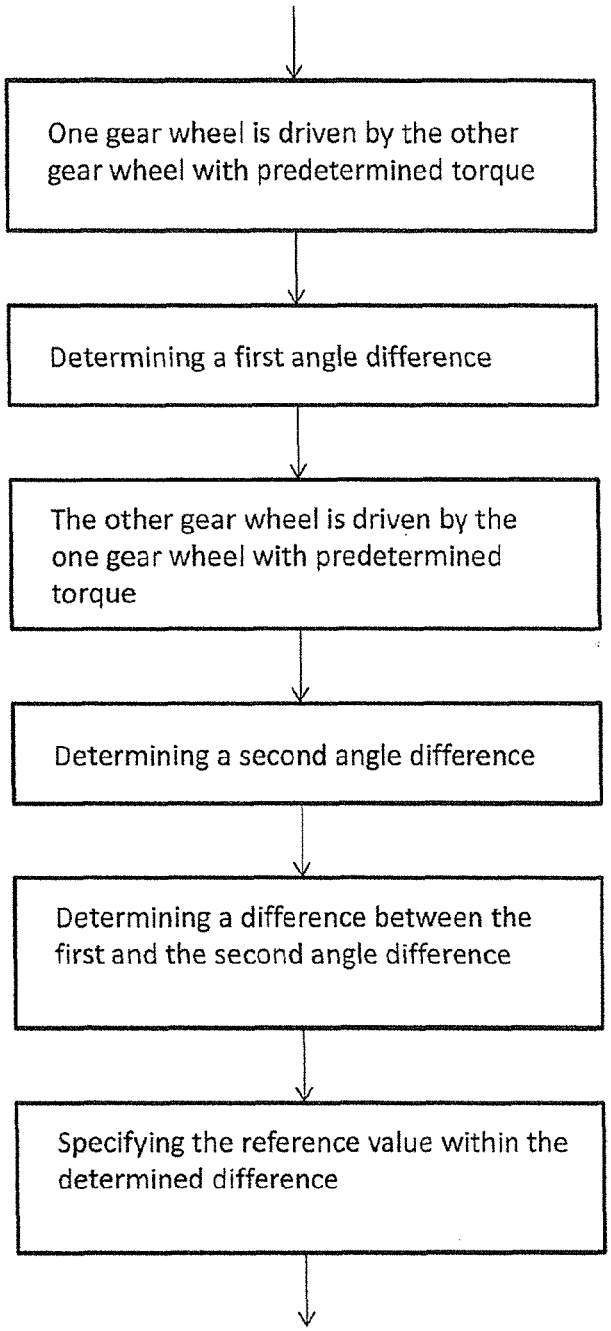

In a second step, the third box in the flow chart of FIG. 11, the second shaft 3 drives the first shaft 2 with the same defined torque as in the first step. Thereby, a second absolute rotation angle difference is determined, as indicated in FIG. 11, again with the help of the stated rotary encoder 24 in combination with the sensor unit 25 at each shaft 2 and 3 in that again a difference is determined between the measured value of the one sensor unit 25 and the measured value of the other sensor unit 25'.

In a third step, see the penultimate box in FIG. 11, the difference between the first absolute rotation difference and the second absolute rotation difference is determined. This difference is the actual range within which the gear wheels can move to each other, provided that the defined torque that was used in the first and second step for the measurement is not exceeded. In this range a reference value can now be specified with respect to which the current positions of the gear wheels are indicated as denoted in the last box in FIG. 11. The reference value is then an origin of a defined coordinate system which can be used in the method as shown in the flow chart of FIG. 10. For instance the reference value lies in the middle between the tooth flanks of a tooth gap such that the absolute values of the maximum displacements are identical.

For the operating condition explained with the help of FIG. 5 a constant force FO is transferred between the gear wheels 11 and 12 as illustrated in the detailed view X on the right hand side of FIG. 5.

In this way the operating conditions can now be chosen after the specification of the reference point in a first setting such that a gear wheel transfers half plus a defined percentage of the total torque. Accordingly, the other gear wheel then transfers half minus the defined percentage of the total torque.

Under these operating conditions a defined sealing can be achieved between the tooth flanks. The application area of these operating conditions is aimed at conveying of low-viscosity fluids for which a sealing action is necessary between the tooth flanks in order to achieve a sufficient sealing between the discharge side D and the suction side S.

A further setting consists in that the gear lash between the flanks of two meshing gear wheels is chosen as operating condition. Namely, for instance in 10% steps from the contact of the flanks (no gear lash) via a central alignment (i.e. the tooth meshing into a tooth gap lies exactly in the middle of the gap) up until the tooth flanks touch each other again, where this time this pertains to the trailing tooth flank.

Figure 6:
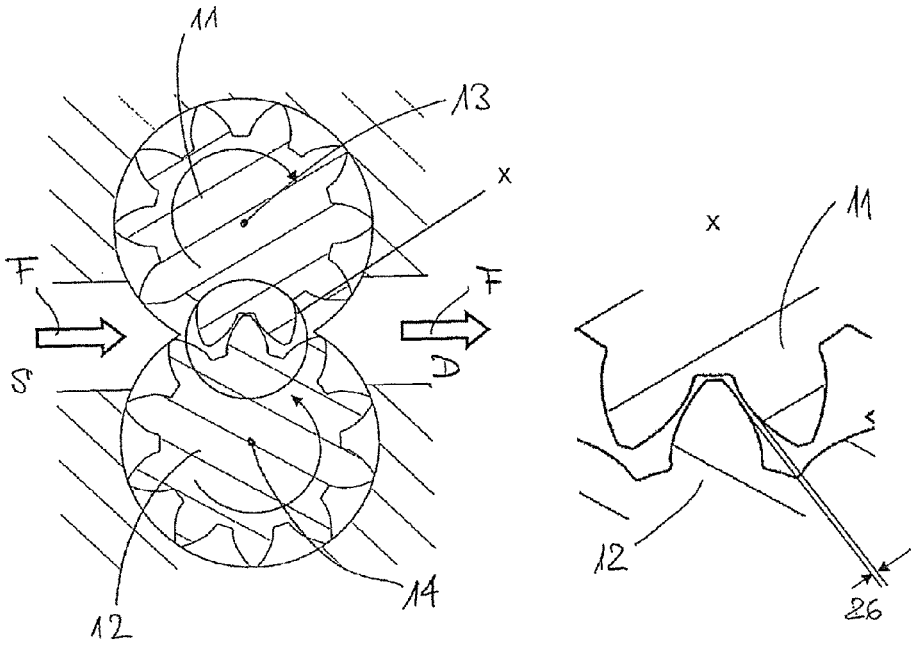
Figure 7:
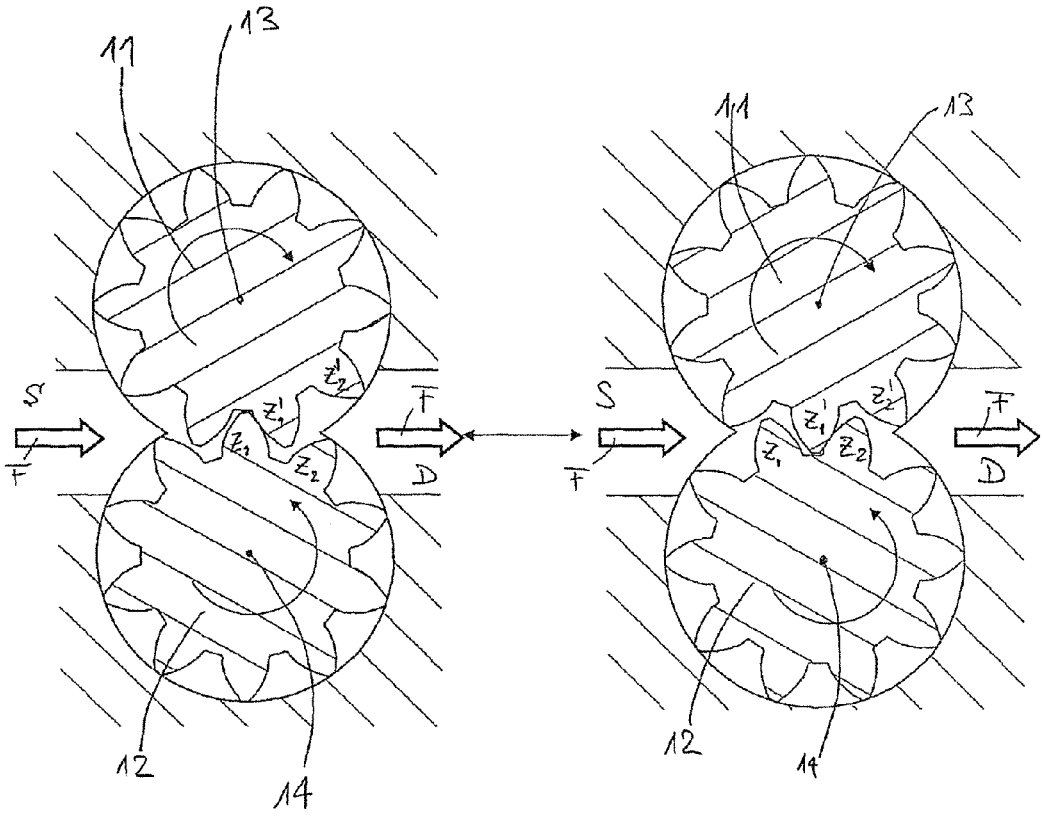

FIG. 6 illustrates the operating conditions explained above again in a cut across the rotary axes 13 and 14 in the region of the gear wheels 11 and 12. Here also a section X in the region of the cogging gear wheels 11 and 12 is presented enlarged in detail, where further a preset gear lash 26 is highlighted.

These operating conditions are selected if the medium F to be conveyed has a medium viscosity. With the setting of the gear lash 26 the extrusion pressure can be set so that it is preferably equal to the pressure on the discharge side D. An excessive gear lash 26, which leads to a smaller extrusion pressure than the pressure on the discharge side D, must be avoided, since an insufficient sealing effect is obtained between the discharge side D and suction side S. The operating condition at which a certain amount of gear lash 26 (i.e. without flank contacts) is present can then be implemented with a corrosion-resistant (and thus often soft) coating of the gear wheels without causing damage due to abrasion.

A further setting consists in that a mode with a changeover of flanks is proposed as operating conditions. Thereby, a gear wheel changes the flanks during the theoretical roll-off of a tooth on the line of action. The extrusion pressure discharge thus always occurs toward the suction side S.

The mode with a changeover of flanks is explained with the help of FIG. 7 which again shows sectional views across the rotary axes 13, 14 in a region of the gear wheels 11, 12. On the left hand side of FIG. 7 a state is shown in which the tooth $Z_1'$ of the gear wheel 11 is meshing into a tooth gap of the gear wheel 12 and touching the tooth $Z_1$. On the right hand side of FIG. 7 a later state is shown in which the tooth $Z_2$ of the gear wheel 12 is meshing into a tooth gap of the gear wheel 11 and touching the tooth $Z_1'$. Thereby, the mentioned changeover of flanks took place in the meantime.

The mode with a changeover of flanks offers at least one of the following advantages:

- minimization of the pulsation due to the extrusion pressure by means of discharging the extrusion pressure to the suction side S;
- minimization of the applied torque by minimization of the extrusion pressure energy;
- reduction of the temperature increase by minimization of the extrusion pressure energy.

The operating conditions according to the mentioned mode with a changeover of flanks is for instance applied for highly viscous media with which the extrusion pressure becomes so high that a very large torque is required in order to generate the extrusion pressure energy, since the latter represents a pure loss in terms of energy.

The extrusion behavior can be specifically varied using the flexibility of an electronic control system in dependence of the properties of the medium to be pumped, i.e. the flow characteristics or the solid loading of the polymer to be conveyed. In this way an optimal speed profile can be assigned to each type of polymer.

Figure 8:
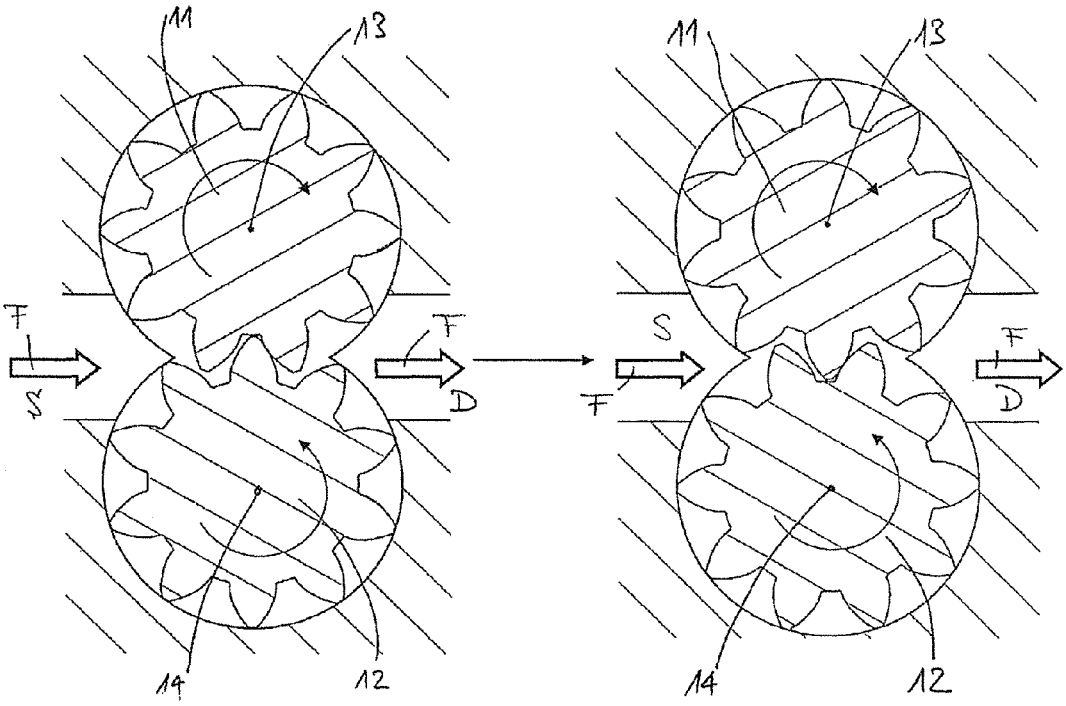

With the help of FIG. 8 a further aspect of the method according to the present invention is explained. Based on knowledge about the current position of the one gear wheel 11 with respect to current position of the other gear wheel 12, for instance from application of the explained steps for a calibration, and the maximum backlash (difference between the first absolute rotation difference and the second absolute rotation difference) for a current position of the one gear wheel 11 with respect to the current position of the other gear wheel 12 a statement can now be made about the wear of the gear wheels 11, 12. For instance, when the maximum backlash for a certain torque transferred from one gear wheel 11, 12 to the other gear wheel 12, 11 changes. When for example the backlash is increased beyond a predetermined maximum threshold this can be interpreted such that a gear wheel and/or a shaft with a gear wheel must be replaced shortly since for instance a failure of the system must be expected soon. Thus, when for a gear pump set according to the left half of FIG. 8 to always extrude to the suction side S the maximum allowed wear (i.e. the maximum allowed backlash on one side, departing from the reference value) is exceeded the operating conditions are adapted automatically or following a corresponding manual intervention of a supervising person. The adaptation of the operating conditions can thereby take place such that henceforth the necessary sealing is transferred to the other tooth flanks. According to the right half of FIG. 8 this is the leading tooth flank of a tooth meshing into a tooth gap.

It is also conceivable that when discovering a wear the current position of the one gear wheel with respect to the current position of the other gear wheel is changed such that the originally desired optimal operating conditions are maintained. For instance, a lifting off of the tooth flanks can occur due to the wear. The corresponding correction in order to restore the desired operating conditions would then be a change of current position of the one gear wheel with respect to the current position of the other gear wheel so that the tooth flanks touch each other in the desired manner again and that the desired backlash is obtained again.

The monitoring of wear can also be utilized so that when a predetermined wear is discovered an acoustic and/or optical warning is given to the supervising person so that precautions can be taken to prevent a failure of the pump system. Doing so, it is conceivable that upon activation of an alarm a replacement shaft or replacement gear wheel is ordered from the manufacturer early enough so that the required spare parts are available on-site before a possible failure of the pump system occurs.

In some extrusion systems in which gear pumps are used pressure fluctuations due to the mentioned extrusion process of residual volumes between the gear wheels are disturbing. These pressure fluctuations are also termed pulsations and lead to irregularities in the product generated by the extrusion. For this reason, various measures have been proposed to reduce the pressure fluctuations. To be mentioned is the use of helical gearing or double helical gearing, both of which however have system-related disadvantages.

According to the present invention pressure fluctuations are eliminated or at least strongly reduced by actively influencing the rotary speed of the two gear wheel shafts.

The arrangement according to the invention as well as the method according to the invention is able to vary the course of the rotary speed per extrusion process in such a way that the pressure on the discharge side lies within narrow limits or that the pressure on the discharge side is constant. Thus, the extrusion process of the medium to be conveyed is specifically controlled from the bottom of the tooth via the current position of the one gear wheel with respect to the current position of the other gear wheel.

It has become apparent that it is indeed generally desirable that the pressure fluctuations can be completely eliminated. However, in certain applications specific pressure fluctuations can be desirable so that appropriate variations are obtained in the thickness of the extrudate. Therefore the method according to the inventive opens up new manufacturing possibilities in the field of extrusion, particularly in connection with the arrangement according to the invention including a gear pump.

In order to achieve a simple and at the same time complete elimination of pressure fluctuations a contact ratio of 1 must be selected. If a contact ratio of 1 is chosen then always only one pair of teeth is engaged in the displacement, i.e. the extrusion (see Vogel Fachbuch Jarosla and Monika Ivantysyn: "Hydrostatische Pumpen and Motoren", 1993, p. 319). In this case a sinusoidal curve results for the displacement volume flow. It can be easily and efficiently corrected via a sinusoidal compensation table (for instance a so-called "look-up" table).

Figure 9:
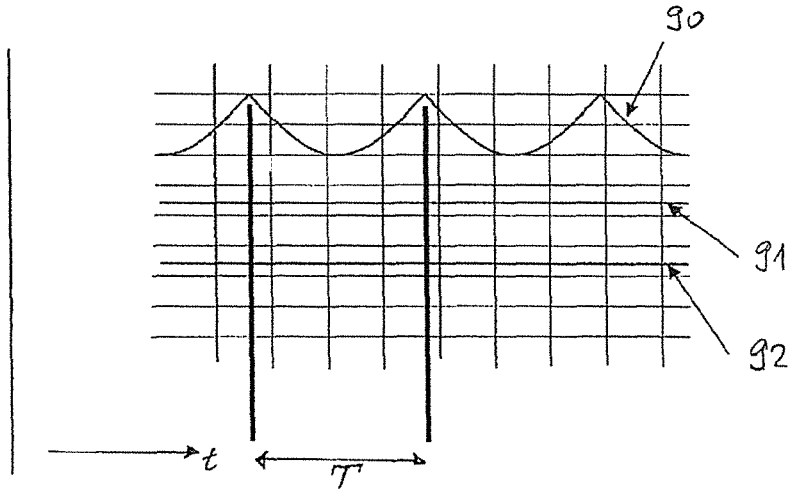

In FIG. 9 a rotary speed curve 90 of the gear wheel pump shaft, a pressure curve 91 of the pressure on the discharge side of the gear pump and a torque curve 92 of the torque of the gear wheel pump shaft are illustrated. The rotary speed curve 90, the pressure curve 91 and the torque curve 92 are plotted as a function of time. The rotary speed of the gear wheel pump shaft is adjusted in such as way as a function of time that the pressure on the discharge side of the gear pump is constant or at least lies within a predetermined tolerance range. The rotary speed curve 90 shown in FIG. 9 has a periodicity with a period T. It is the time period during which a meshing into a corresponding gap takes place. If the rotary speed of both shafts is now synchronously controlled according to the rotary speed curve 90 the pulsation can be fully compensated.

It is pointed out that the pulsation compensation can be combined with all the operating conditions or specifications outlined in this description.

Due to the periodicity it is possible to store the rotary speed curve 90 in a storage unit (look-up table). The values for the rotary speed to be set are then read out in a given cycle, wherein the predetermined cycle arises on the discharge side due to the pressure to be set.

Alternatively, it is also possible, to measure the pressure on the discharge side with a pressure sensor and to use the rotary speed based on the measured pressure for setting the rotary speed. This so-called on-line pressure setting procedure is indeed more costly to implement but other applications are made possible for realizing specific manufacturing processes in the field of extrusion.

The specific manipulation of the position control as has been explained above to prevent or reduce the pulsation of the pressure on the discharge side of a gear pump can also be used to reduce the total shear loading for shear sensitive materials. For this care is taken when determining the rotary speed curve to ensure that a maximum shear stress is not exceeded.

The present invention makes it possible for the first time to specifically influence the effects of pulsation, extrusion pressure and tribological behavior. With the settings all the effects, which are of importance for the specific case, can be taken into account, or individual operating conditions can be considered as a priority. What this means is that the operating conditions should have a greater influence on the behavior of the entire system.

The advantage of the involute toothing typically used for gear pumps is that the transmission ratio of the two rotational speeds remains constant during a rotation, which is a basic prerequisite for a constant volume flow. In contrast, circular arc gear teeth have the disadvantage that the transmission ratio of the rotational speed of the shafts varies periodically and thus the flow of the conveyed medium pulsates. The use of the described invention with two controlled drive units makes it possible for the first time to employ circular arc gear teeth without an unwanted pulsation of the current of the conveyed medium arising. Thus, with a sufficiently large backlash, the drive speeds of the shafts can be corrected and compensated for with an opposing velocity profile, so that circular arc gear teeth become possible with a constant transmission ratio and hence constant volume flow.

As with the mentioned circular arc gear teeth other tooth forms are also conceivable. Merely the velocity profile needs to be adapted accordingly.

The invention claimed is:

1. A method of controlling a gear pump comprising two meshing gear wheels, wherein the two gear wheels are driven via respective shafts each by a drive unit, the method comprising determining a current position of the one gear wheel with respect to the current position of the other gear wheel and continuously adjusting the current position of the one gear wheel with respect to the current position of the other gear wheel according to specified predefined operating conditions, wherein the determination of the current position of the one gear wheel with respect to the current position of the other gear wheel is adjusted via a reference value, which is determined in a calibration before the normal operation of the gear pump or during interruptions of the normal operation of the gear pump, wherein the reference value lies in the middle between tooth flanks of a tooth space of a gear wheel, and wherein in the calibration the reference value is determined during rotation of the gear wheels in that, the one gear wheel is driven by the other gear wheel with a predetermined torque, a first angle difference is determined by calculating the difference between values measured with rotary encoders/sensor units, the other gear wheel is driven by the one gear wheel with a predetermined torque, a second angle difference is determined by calculating the difference between values measured with the rotary encoders/sensor units, a difference is determined between the first angle difference and the second angle difference, and the reference value is specified within the determined difference.

2. The method according to claim 1, further comprising monitoring at least one of the following current values:

the first angle difference, a difference between the first angle difference and the reference value, the second angle difference, a difference between the second angle difference and the reference value, and in case of under- or overshooting of the at least one of the current values below a predefined value executing at least one of the following actions:

an optical warning, optical display, acoustic warning, change of operating conditions of the gear pump.

3. The method according to claim 1, wherein rotary encoders/sensor units are applied for determining the current position of the one gear wheel and the second gear wheel, wherein each rotary encoder/sensor unit is arranged centrally between the toothing of the respective gear wheel and a rotor of the respective drive unit.

4. The method according to claim 1, including adjusting a predefined gear lash between the two meshing gear wheels.

5. The method according to claim 1, wherein a leading flank, in the direction of rotation of the one gear wheel, of a tooth meshing into a tooth gap touches a lagging flank, in the direction of rotation of the other gear wheel, and a leading flank, in the direction of rotation of the other gear wheel, of a tooth meshing into a tooth gap touches a lagging flank, in the direction of rotation of the one gear wheel.

6. The method according to claim 1, wherein the one gear wheel drives the other gear wheel with a predetermined torque, wherein the predetermined torque is greater than half of the total torque generated by both drive units.

7. The method according to claim 1, wherein the rotary speed of the shafts driven by the drive units is synchronously adjusted in such a way that a pressure of a medium to be conveyed stays substantially constant on a discharge side of the gear pump.

8. The method according to claim 1, further comprising measuring the pressure of a medium to be conveyed on the discharge side of the gear pump and adjusting the rotary speed in dependence of the measured pressure of the medium.

9. The method of claim 1, wherein the gear pump being controlled is part of an arrangement where the gear pump includes a pump housing, the two meshing gear wheels are contained in the pump housing and the two shafts are operatively connected to the gear wheels and extend through the pump housing, wherein the two shafts are each operatively connected to the respective drive units, wherein a coupling unit for compensation of eccentricities between the drive unit and the respective shaft is arranged between each gear wheel and drive unit, and wherein a rotary encoder/sensor unit is arranged between the center of the gear wheel and the center of the respective drive.

10. The method according to claim 9, wherein in said arrangement in which the gear pump is being controlled the rotary encoder/sensor unit is located in an axial region which is defined by the center between the center of the gear wheel and the center of the drive unit plus a deviation on both sides of at most 10% of the distance between the center of the gear wheel and the center of the drive unit.

11. The method according to claim 10, wherein in said arrangement in which the gear pump is being controlled the rotary encoders/sensor units are respectively arranged in the middle between the respective center of the gear wheel and the respective center of the drive unit.

12. The method according to claim 9, wherein in said arrangement in which the gear pump is being controlled the rotary encoders/sensor units feature a radial distance to a rotation axis of the respective shaft which is at least twice as large, as the outer radius of the gear wheels.

* * * * *